US010588383B2

(12) United States Patent
Nanbu

(10) Patent No.: US 10,588,383 B2
(45) Date of Patent: Mar. 17, 2020

(54) BUCKLE

(71) Applicant: YKK Corporation, Tokyo (JP)

(72) Inventor: Madoka Nanbu, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/075,217

(22) PCT Filed: Feb. 5, 2016

(86) PCT No.: PCT/JP2016/053475
§ 371 (c)(1),
(2) Date: Aug. 3, 2018

(87) PCT Pub. No.: WO2017/134811
PCT Pub. Date: Aug. 10, 2017

(65) Prior Publication Data
US 2019/0037973 A1 Feb. 7, 2019

(51) Int. Cl.
*A44B 11/25* (2006.01)
*A44B 11/00* (2006.01)
*A44B 11/26* (2006.01)

(52) U.S. Cl.
CPC ..... *A44B 11/2534* (2013.01); *A44B 11/006* (2013.01); *A44B 11/2592* (2013.01); *A44B 11/266* (2013.01)

(58) Field of Classification Search
CPC ..... A44B 11/006; A44B 11/2534; A44B 11/2592; A44B 11/266
See application file for complete search history.

(56) References Cited

U.S. PATENT DOCUMENTS

D558,087 S * 12/2007 Pontaoe ..... D11/216
7,979,966 B2 * 7/2011 Yoshie ..... A44B 11/266 24/614

(Continued)

FOREIGN PATENT DOCUMENTS

JP 07-051106 A 2/1995
JP 2006-129952 A 5/2006

(Continued)

OTHER PUBLICATIONS

International Search Report, PCT Patent Application No. PCT/JP2016/053475, dated Apr. 5, 2016.

(Continued)

*Primary Examiner* — Robert Sandy
*Assistant Examiner* — David M Upchurch
(74) *Attorney, Agent, or Firm* — Kilpatrick Townsend & Stockton LLP

(57) ABSTRACT

Provided is a buckle including a plug and a socket. The plug includes a pair of leg portions, each of which is provided with an engaging portion, and outer and inner leg pieces extending while opposing each other. In the vicinity of a distal end portion of the leg portion, the outer and inner leg pieces are connected to each other by a distal end connection portion. On a base end portion of the leg portion, the outer and inner leg pieces are connected to each other by an arm portion. Opposing arm distal end portions of the arm portions are formed to define a slit having a predetermined space between the leg portions. The opposing arm distal end portions are connected to guide portions extending in a protruding direction of the leg portions. The pair of leg portions is provided to be swingable across the slit.

6 Claims, 19 Drawing Sheets

(56) References Cited

U.S. PATENT DOCUMENTS

| | | | | |
|---|---|---|---|---|
| 8,112,850 | B2 * | 2/2012 | Uehara | A44B 11/266 24/197 |
| 8,286,311 | B2 * | 10/2012 | Paik | A44B 11/266 24/614 |
| 8,522,409 | B2 * | 9/2013 | Uehara | A44B 11/266 24/604 |
| 9,113,680 | B2 * | 8/2015 | Takazakura | A44B 11/266 |
| 9,585,441 | B2 * | 3/2017 | Kaneko | A44B 11/266 |
| 2003/0196302 | A1 * | 10/2003 | Buscart | A44B 11/006 24/614 |
| 2006/0090310 | A1 * | 5/2006 | Uehara | A44B 11/266 24/614 |
| 2006/0168783 | A1 * | 8/2006 | Anscher | A44B 11/266 24/615 |
| 2007/0017074 | A1 | 1/2007 | Pontaoe | |
| 2007/0204441 | A1 | 9/2007 | Saitsu | |
| 2011/0173783 | A1 * | 7/2011 | Kaneko | A44B 11/266 24/615 |
| 2015/0135494 | A1 * | 5/2015 | Kataguchi | A44B 11/266 24/697.1 |
| 2015/0237972 | A1 * | 8/2015 | Kolasa | A44B 11/26 24/197 |
| 2016/0021984 | A1 * | 1/2016 | Mundhra | A44B 11/005 116/137 R |

FOREIGN PATENT DOCUMENTS

| | | | |
|---|---|---|---|
| JP | 2007-229307 | A | 9/2007 |
| JP | 3179489 | U | 11/2012 |

OTHER PUBLICATIONS

Written Opinion, PCT Patent Application No. PCT/JP2016/053475, dated Apr. 5, 2016.

* cited by examiner

BUCKLE

TECHNICAL FIELD

The present invention relates to a buckle, which has a plug and a socket capable of being engaged with and disengaged from each other and is configured to connect and disconnect separate portions, such as tapes, belts or other members, to and from each other.

BACKGROUND ART

Conventionally, as buckles for detachably connecting two connecting objects together, for example, a buckle as disclosed in Patent Document 1 has been known. The buckle is constituted of a plug and a socket. The plug has a tape passing portion, which is an attachment portion provided with a tape insertion hole configured to allow a tape or the like to be inserted therethrough and connected thereto, and a pair of leg portions extending from both end portions, in a width direction, of the tape passing portion to be parallel to each other. Each of the leg portions has an outer leg piece and an inner leg piece, which are elastically deformable, and also has a distal end connection portion for connecting distal ends of the outer leg piece and the inner leg piece to each other. On a pair of distal end connection portions connecting the distal ends of the outer leg piece and the inner leg piece to each other, a pair of engaging protrusions is provided to protrude in a front and back direction. Base end portions of the outer leg piece and the inner leg piece are connected to an arm portion extending from both end portions, in the width direction, of the tape passing portion, toward the protruding of the leg portions to form a generally V-shape. In a valley portion of the arm portion, a guide bar for guiding insertion of the plug is formed to protrude in the protruding direction of the leg portions. The socket, in which the plug is to be fitted, is also provided with a tape passing portion having a tape insertion hole, and a hollow plug fitting portion is provided to integrally extend from one end portion of the tape passing portion. The plug fitting portion is constituted of an upper plate and a lower plate opened at a distal end portion thereof, and also operation opening portions are respectively formed on both side edges, in the width direction, of the upper and lower plates. On a base end side of the operation opening portions, engaged portions are formed to be respectively engaged with the pair of engaging protrusions of the pair of leg portions inserted in the plug fitting portion.

Also, a buckle disclosed in Patent Document 2 has a basic configuration similar to that of Patent Document 1. However, base end portions of portions of the buckle disclosed in Patent Document 2, which correspond to the outer leg piece and the inner leg piece, are not connected to each other. The portion corresponding to the inner leg piece is formed in a thin plate shape, and the base end portion thereof is formed in a generally U-shape and is connected to a base end portion of a guide bar. A U-shaped shallow groove is formed on a base end portion of the guide bar.

PRIOR ART DOCUMENT

Patent Document

Patent Document 1: Japanese Patent Application Publication No. 2007-229307 A

Patent Document 2: U.S. 2007/0017074 A1

SUMMARY OF INVENTION

Problems to be Solved by Invention

In the buckle disclosed in Patent Document 1, elastic deformation upon operating thereof can easily occur due to the outer leg piece and the inner leg piece, and also breakage thereof due to a force, which acts outward, can be prevented. However, during a disengaging operation, distal end sides of the outer leg piece and the inner leg piece are bent and elastically deformed to disengage the engaging protrusions from the engaged portions. At that time, a compressive force is exerted on the inner leg piece in a length direction thereof. As a result, there is a problem that the inner leg piece becomes an unyielding state and thus feeling of the disengaging operation is hard.

Further, in the case of the buckle disclosed in Patent Document 2, base end portions of the outer leg piece and the inner leg piece are not connected by an arm portion as in Patent Document 1. Thus, there is a disadvantage that if a force causing the outer leg piece to be opened outward is exerted thereon, the outer leg piece tends to be broken. Also, in such a case, even if not broken, there is also a problem that the outer leg piece and the inner leg piece are easily deformed and thus the engaging protrusions tend to be disengaged.

The present invention has been made keeping in mind the above problems of the background arts, and an object thereof is to provide a buckle, in which operability of a plug is good and also the plug and a socket can be reliably engaged with each other.

Means for Solving Problems

The present invention is a buckle, including a plug and a socket capable of being connected to each other and having attachment portions, respectively, configured to be attached to respective predetermined members, wherein the plug includes a pair of leg portions protruding from the attachment portion, wherein each of the pair of leg portions is provided with an engaging portion, wherein each leg portion includes an outer leg piece and an inner leg piece extending while opposing each other, wherein in the vicinity of a distal end portion of the leg portion, the outer leg piece and the inner leg piece are connected to each other by a distal end connection portion and also on a base end portion of the leg portion, the outer leg piece and the inner leg piece are connected to each other by an arm portion, wherein opposing arm distal end portions of the arm portions are formed to define a slit having a predetermined space between the leg portions, wherein the opposing arm distal end portions are connected to guide portions extending in a protruding direction of the leg portions, wherein the pair of leg portions is provided to be swingable across the slit.

The guide portions may extend from the arm distal end portions to be parallel to each other to define the slit therebetween. Also, a pair of arm portions may be formed to extend toward the protruding direction of the leg portions as the arm portions go from portions thereof connected to the outer leg pieces toward the arm distal end portions.

A length dimension of the slit along the protruding direction may be set to be greater than a half of a length dimension of the guide portions along the protruding direction.

Further, a distal end portion of the guide portions may be positioned toward the base end portions of the leg portions rather than the distal end portions thereof. Further, a distal end portion of the guide portions may protrude in the protruding direction of the leg portions relative to the distal end portions of the leg portions.

Advantageous Effects of Invention

According to the buckle of the present invention, disengaging of the plug can be performed with a relatively smaller force, thereby achieving a good operability. Also, other than a normal disengaging operation, even if a greater external force is exerted on the leg portions of the plug, deformation of the leg portions is small and also the plug is not easily disengaged. Further, if a force causing the leg portions of the plug to be deformed outward is exerted thereon, breakage thereof hardly occurs.

EMBODIMENTS OF INVENTION

Figure 1:
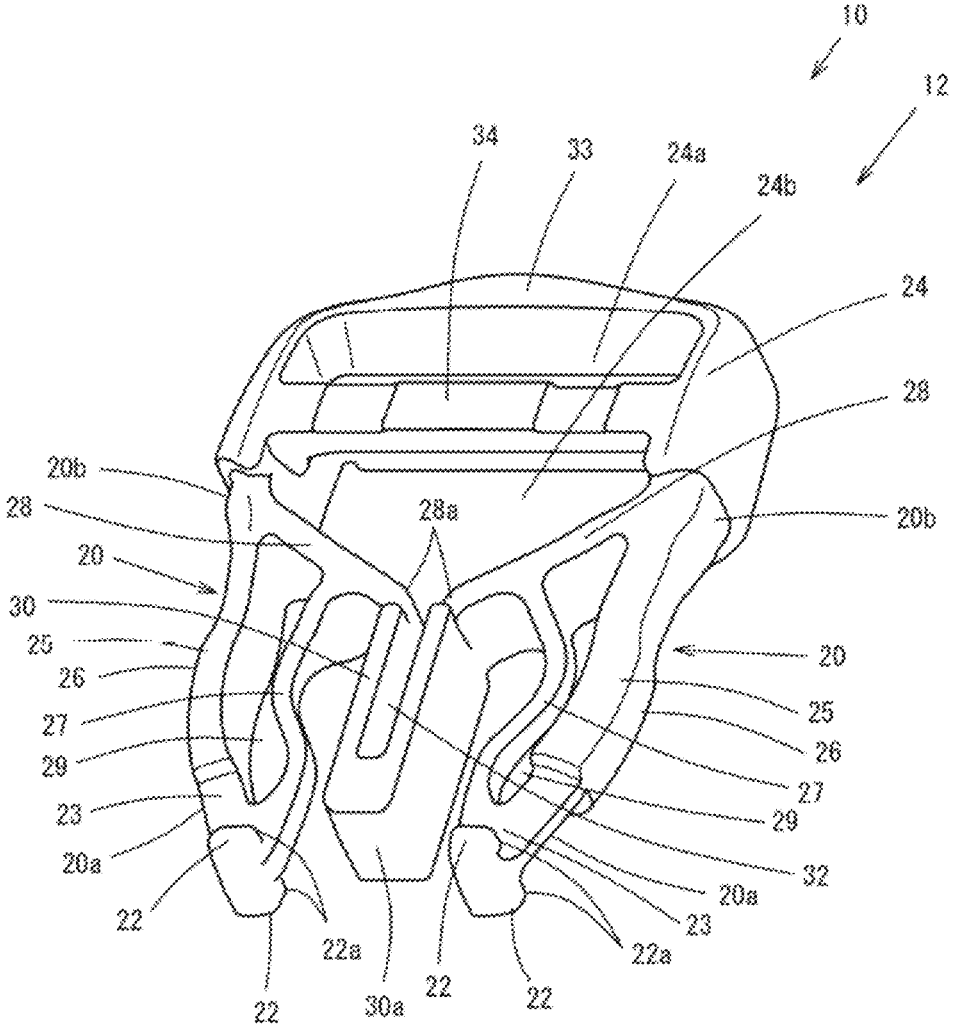
FIG. 1 is a perspective view showing a plug of a buckle according to a first embodiment of the present invention.
Figure 2:
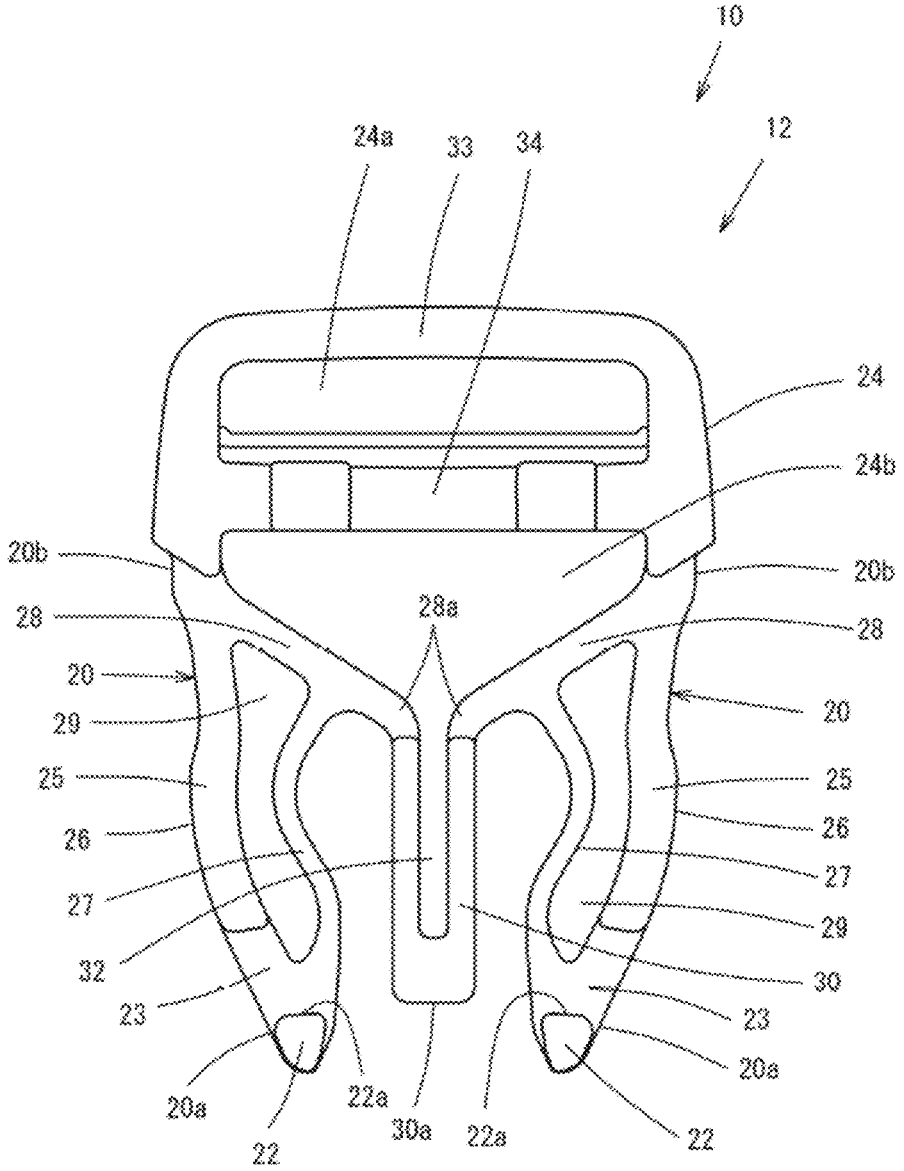
FIG. 2 is a front view of the plug of the buckle according to the first embodiment.
Figure 3:
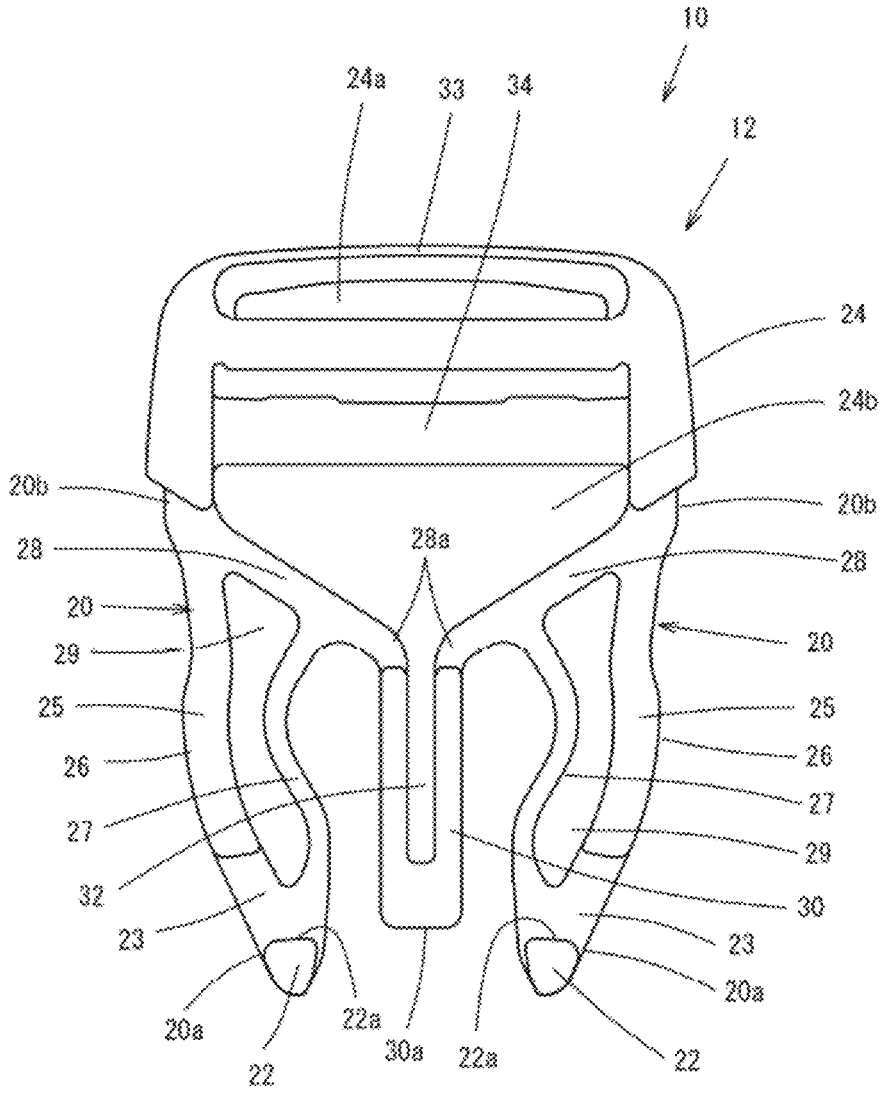
FIG. 3 is a rear view of the plug of the buckle according to the first embodiment.
Figure 4:
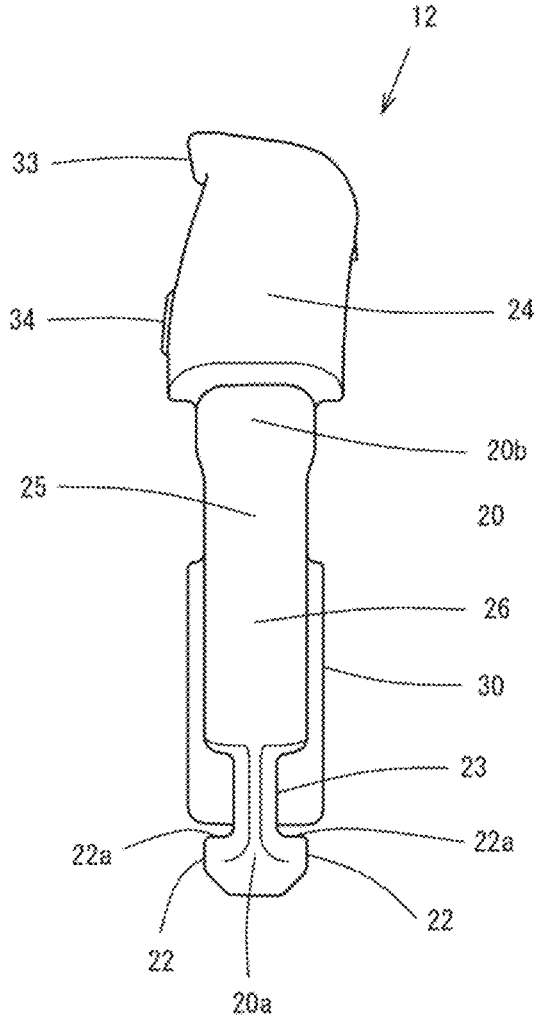
FIG. 4 is a right side view of the plug of the buckle according to the first embodiment.
Figure 5:
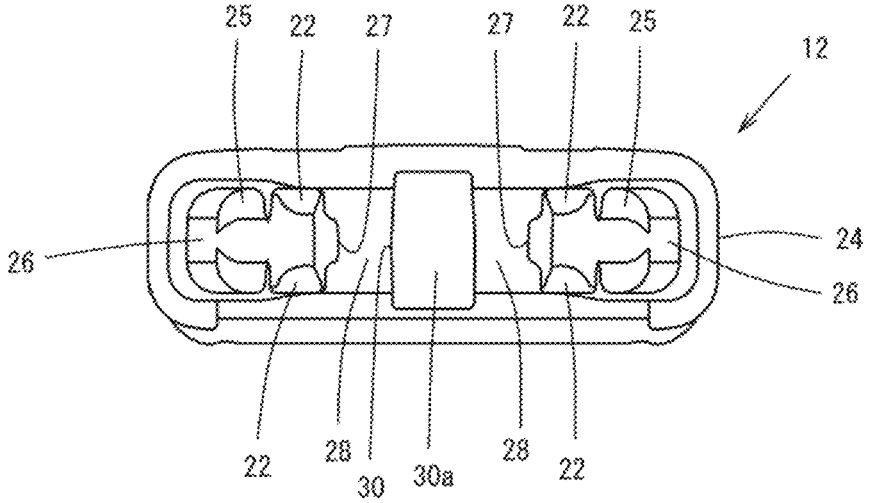
FIG. 5 is a bottom view of the plug of the buckle according to the first embodiment.
Figure 6:
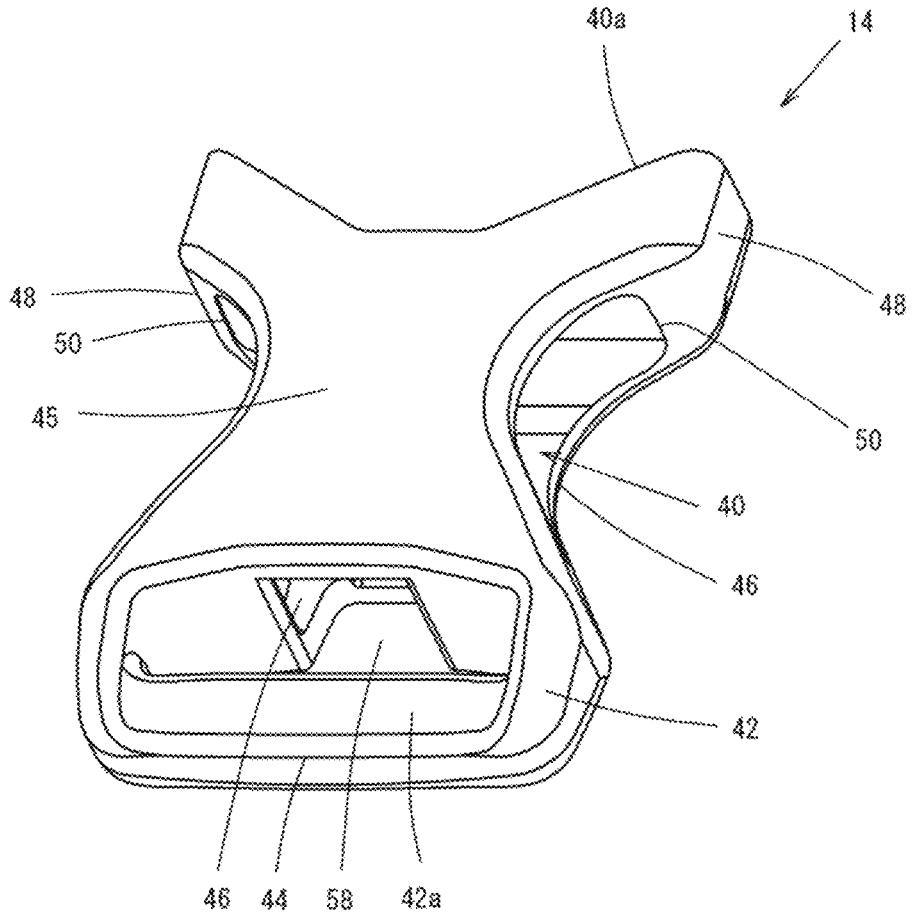
FIG. 6 is a perspective view of a socket of the buckle according to the first embodiment.
Figure 7:
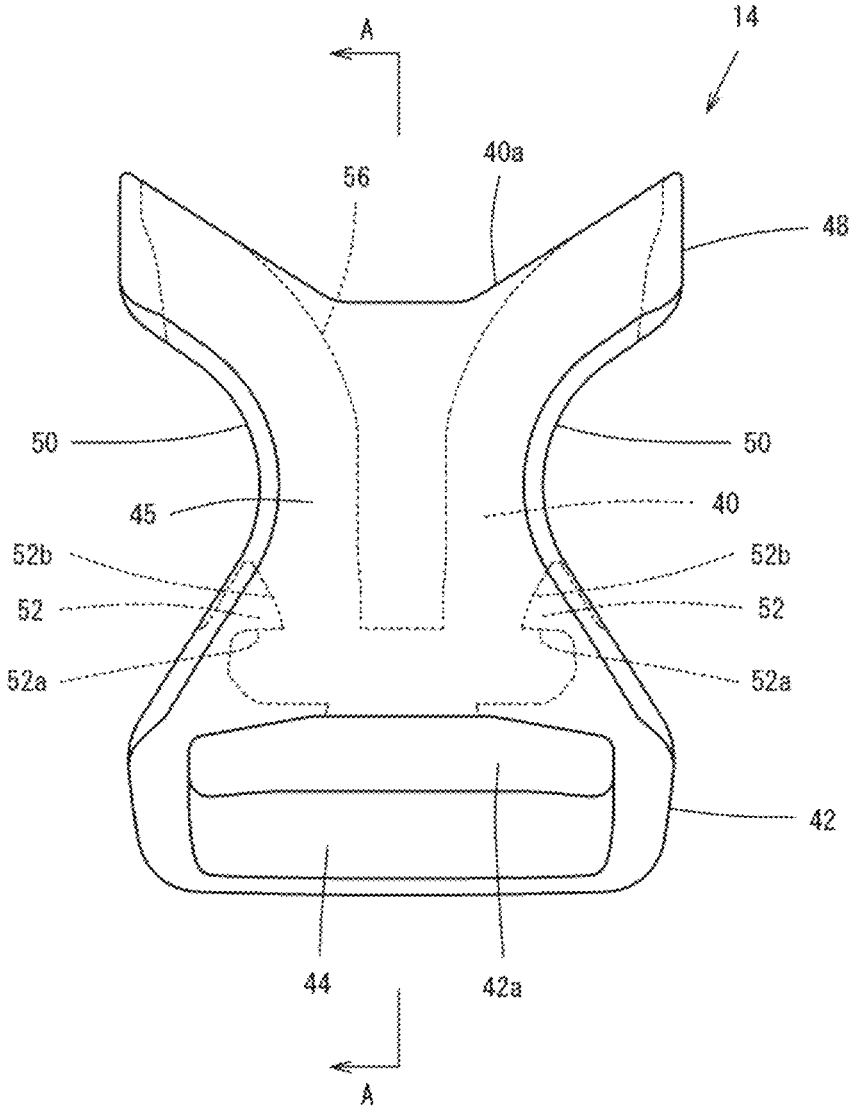
FIG. 7 is a front view of the socket of the buckle according to the first embodiment.
Figure 8:
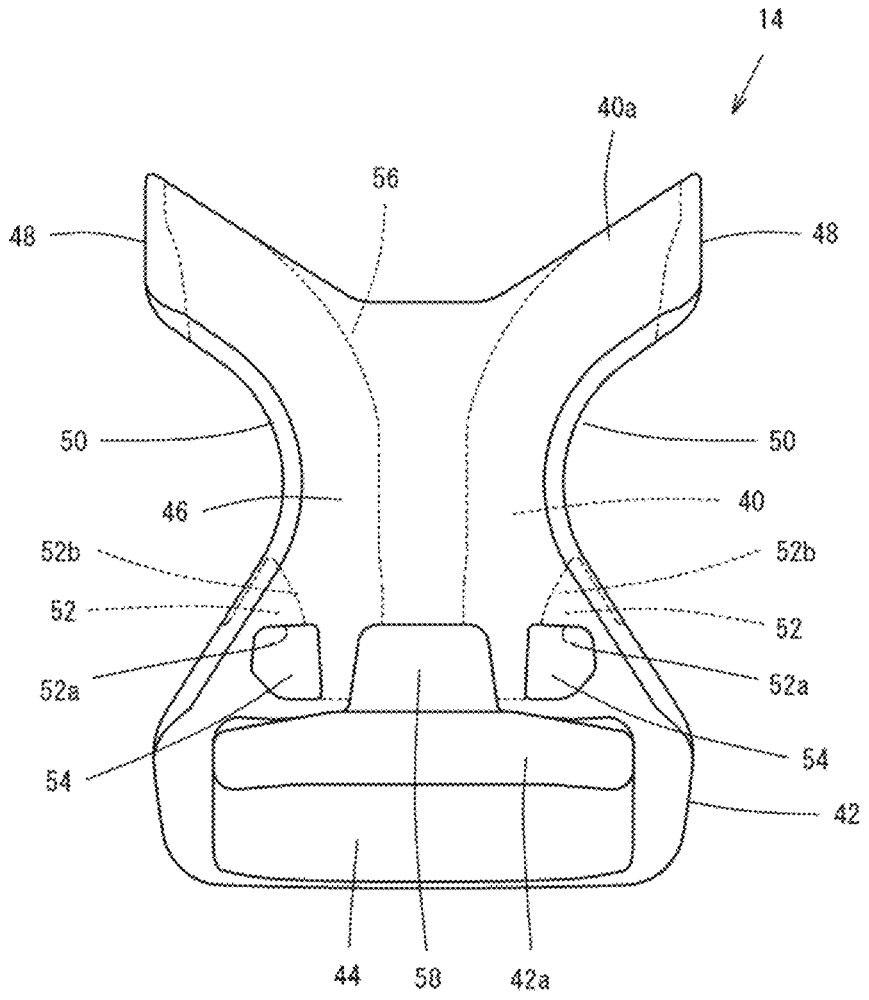
FIG. 8 is a rear view of the socket of the buckle according to the first embodiment.
Figure 9:
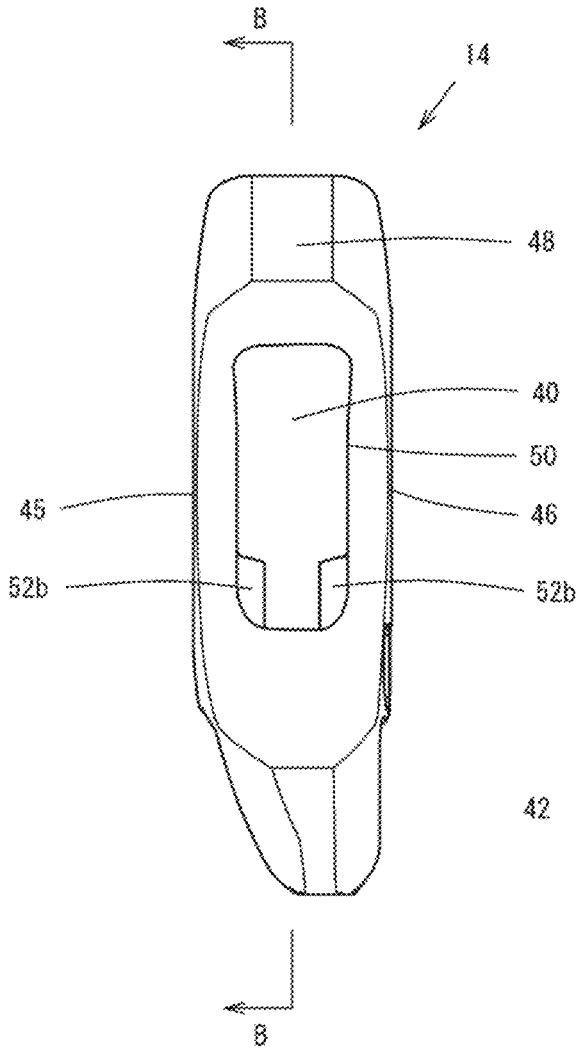
FIG. 9 is a right side view of the socket of the buckle according to the first embodiment.
Figure 10:
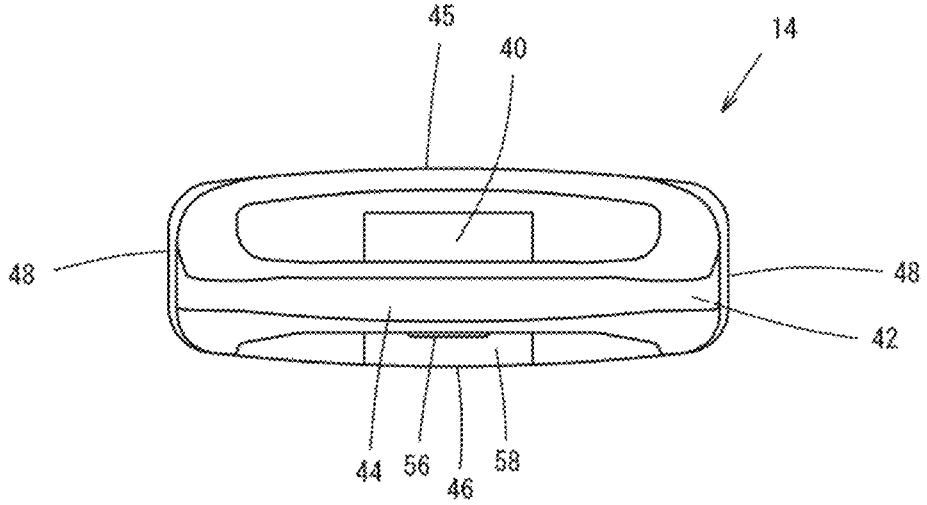
FIG. 10 is a bottom view of the socket of the buckle according to the first embodiment.
Figure 11:
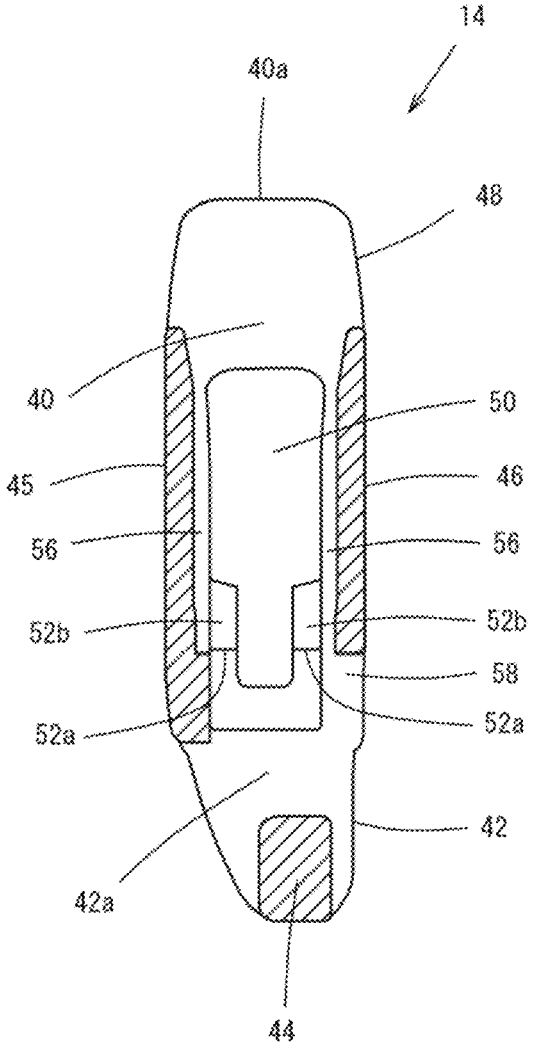
FIG. 11 is a sectional view taken along a line A-A in FIG. 7.
Figure 12:
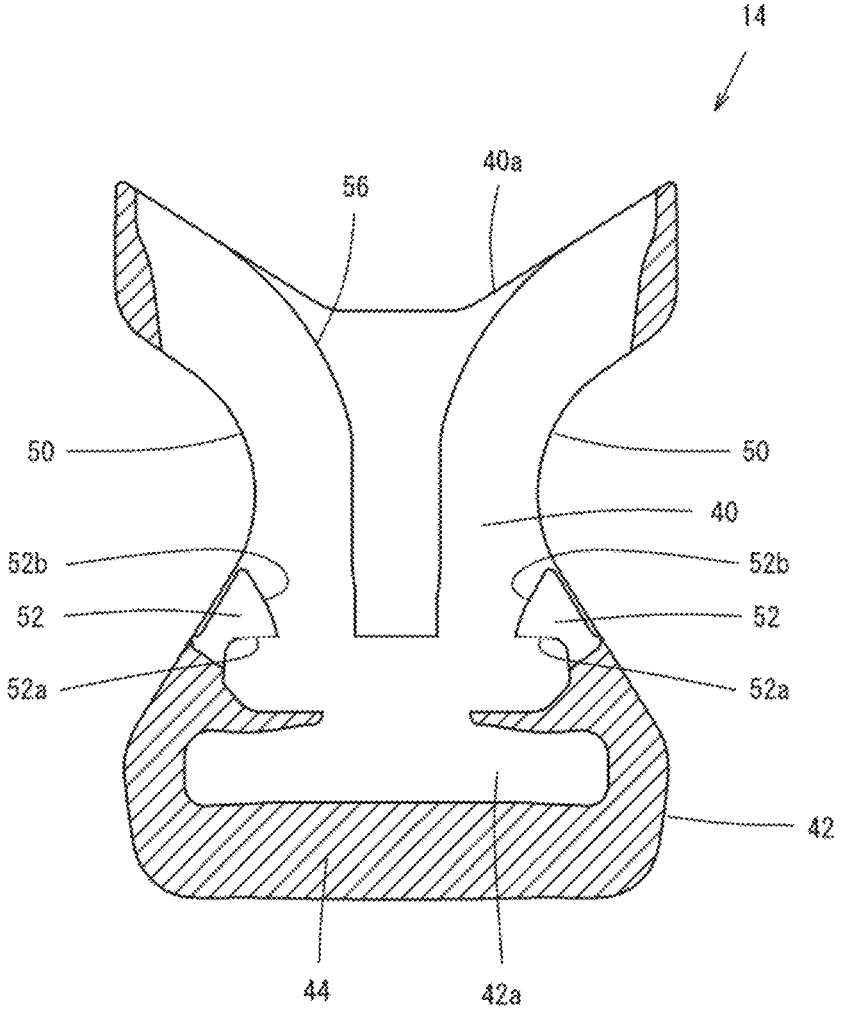
FIG. 12 is a sectional view taken along a line B-B in FIG. 9.
Figure 13:
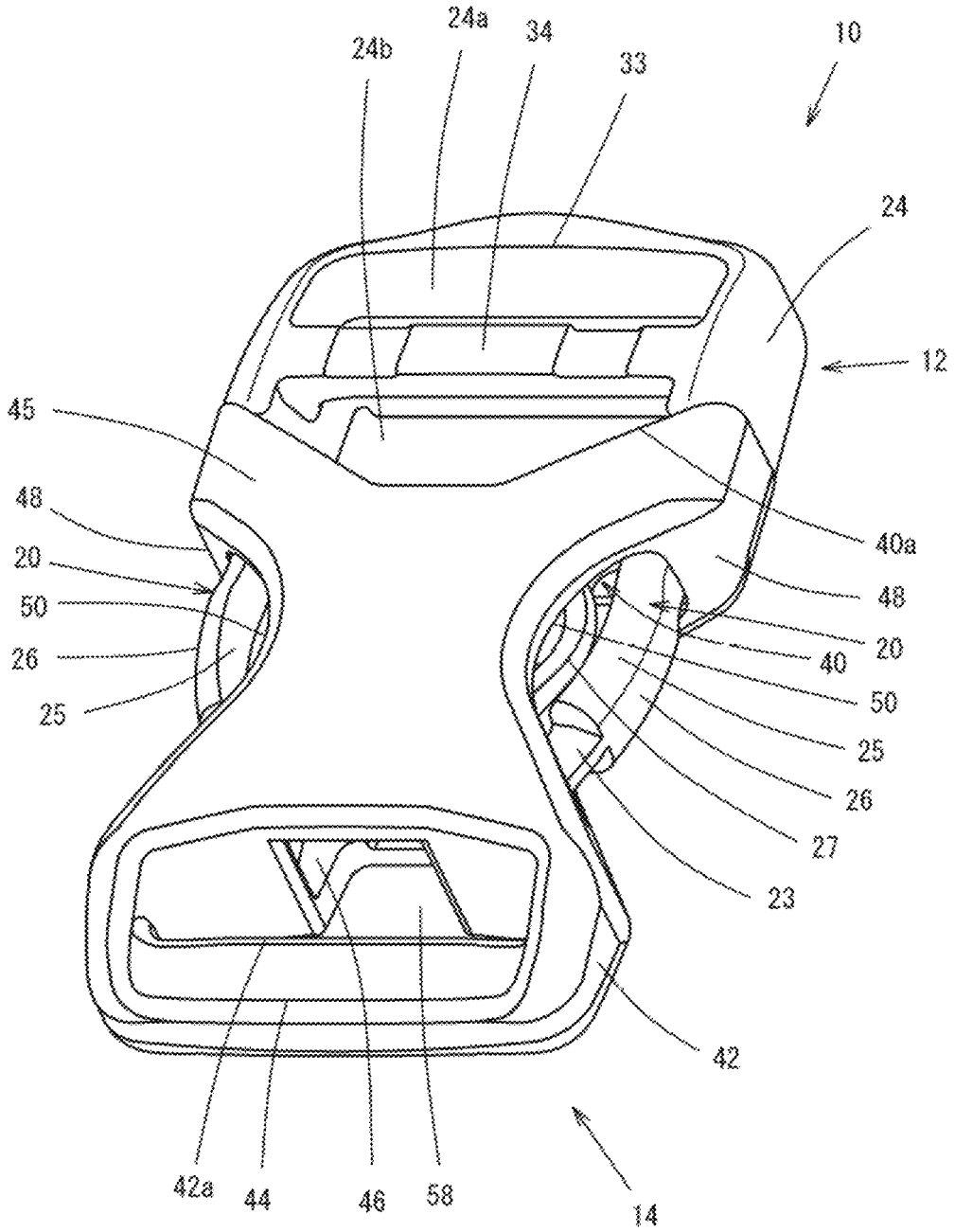
FIG. 13 is a perspective view showing an engaged state of the plug and the socket of the buckle according to the first embodiment.
Figure 14:
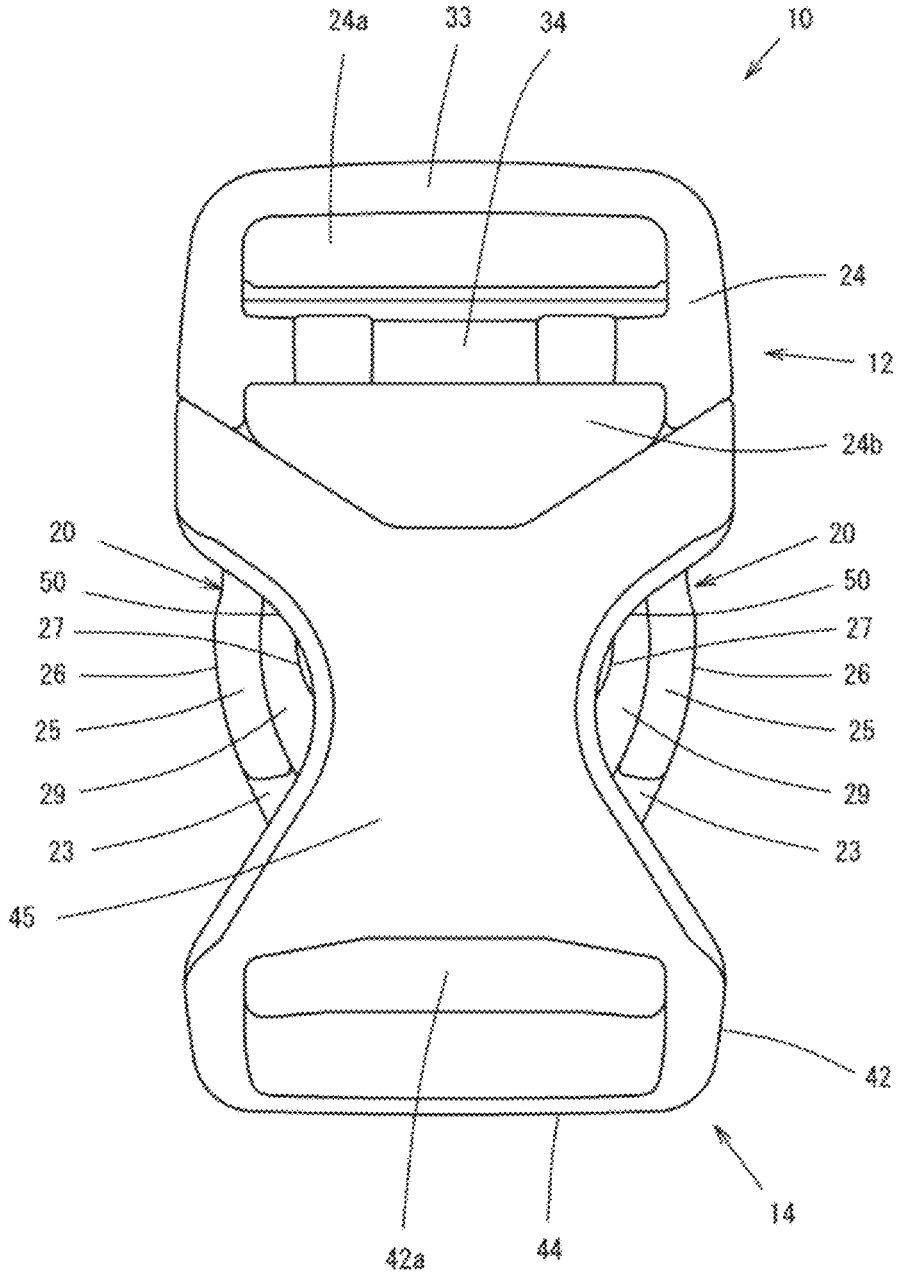
FIG. 14 is a front view showing the engaged state of the plug and the socket of the buckle according to the first embodiment.
Figure 15:
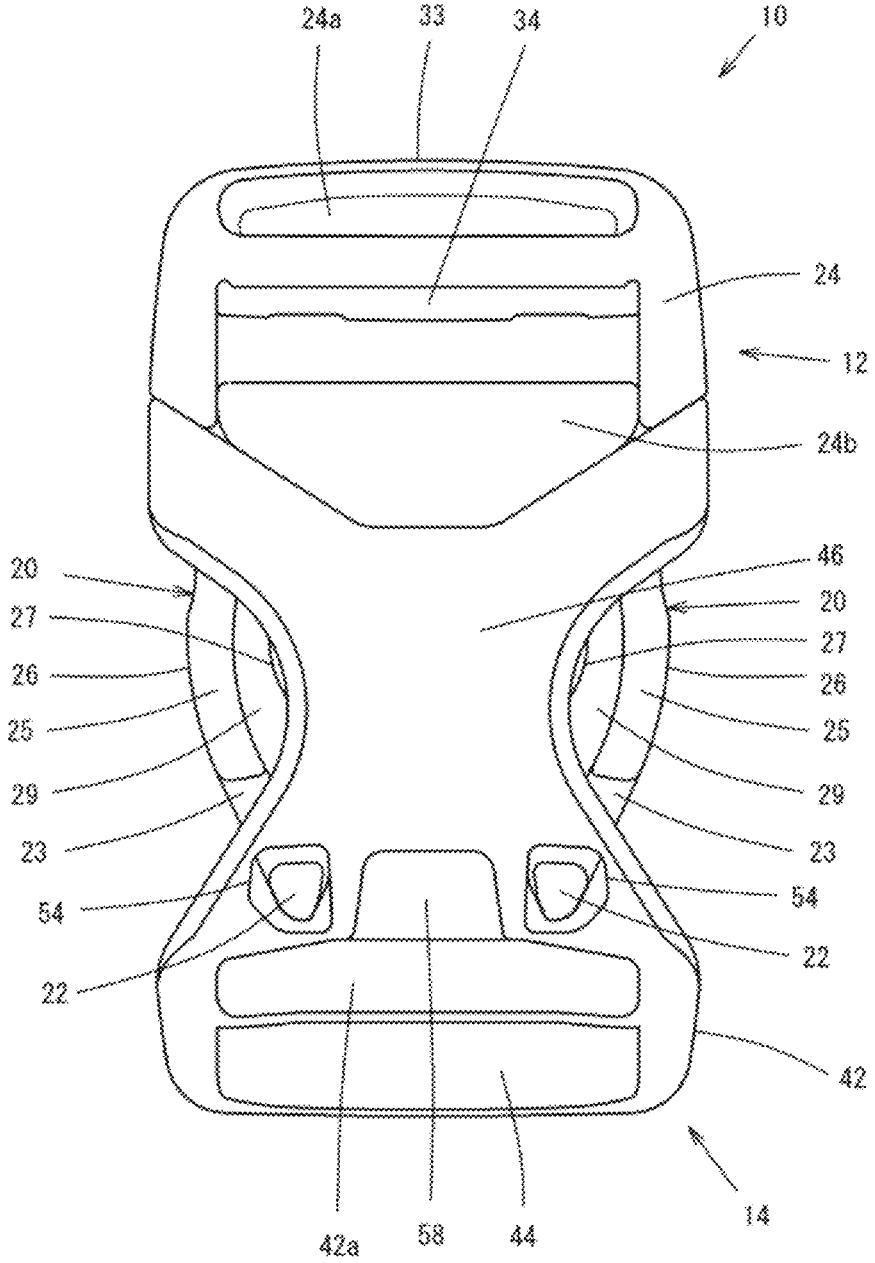
FIG. 15 is a rear view showing the engaged state of the plug and the socket of the buckle according to the first embodiment.

Hereinafter, a buckle 10 of the first embodiment of the present invention will be described with reference to FIGS. 1 to 15. As shown in FIGS. 13 to 15, the buckle 10 is constituted of a plug 12 and a socket 14 configured to allow the plug 12 to be fitted and locked therein. The plug 12 and the socket 14 are respectively attached to a pair of predetermined members, such as tapes, belts or other members, thereby allowing the members to be arbitrarily connected to and disconnected from each other. In the following description, a direction, in which engaging protrusions 22 as engaging portions, which are respectively provided on a pair of leg portions 20 of the plug 12 as described below, oppose each other, is referred to as a right and left direction; a direction, which is perpendicular to the right and left direction and along which the leg portions 20 extend, is referred to as a protruding direction or a forward and back direction, and a direction perpendicular to the right and left direction and the protruding direction is referred to as a front and back direction or a thickness direction.

The plug 12 is formed by integrally molding using a synthetic resin, such as polyacetal, polyamide or polypropylene. As shown in FIGS. 1 to 5, the plug 12 has leg portions 20 configured to be inserted into the socket 14, distal end connection portions 23 respectively located on distal end portions 20*a* of the leg portions 20, and engaging protrusions 22 respectively integrally provided on locations on the distal end connection portions 23, which are closer to the distal end. An attachment portion 24 is integrally provided on base end portions 20*b* of the pair of leg portions 20 opposite to the engaging protrusions 22. The attachment portion 24 serves as a portion intended to allow a predetermined member, such as a tape, a belt or other members, to be inserted therethrough and connected thereto.

The pair of leg portions 20 is configured to symmetrically protrude from the attachment portion 24. Each of the leg portions 20 has an outer leg piece 25 and an inner leg piece 27. The distal end connection portion 23 is integrally provided on distal ends, in the protruding direction, of the outer leg piece 25 and the inner leg piece 27. Thus, the distal ends of the outer leg piece 25 and the inner leg piece 27 are connected to each other. The outer leg piece 25 is configured such that the middle portion thereof in the protruding direction is bulged outward in the right and left direction. The bulged portion is an operating portion 26 for releasing engagement of the plug 12. The inner leg piece 27 is located inside the outer leg piece 25 in the right and left direction and is formed to have a thickness thinner than the outer leg piece 25 in the right and left direction. Also, the inner leg piece 27 is formed in a shape curved outward in the right and left direction with a curvature larger than that of the outer leg piece 25.

The distal end connection portion 23 provided on the distal end portion 20*a* of the leg proton 20 is formed to have a thickness thinner than the operating portion 26 in the front and back direction. Also, the distal end connection portions 23 is located at the middle portions, in the thickness direction, of the outer leg piece 25 and the inner leg piece 27 and extends in the forward and back direction. The engaging protrusions 22 are provided to be located on a distal end of the distal end connection portion 23 and to protrude from both sides thereof in the front and back direction. Each of the engaging protrusions 22 has a locking end portion 22*a* provided on a side thereof facing the base end portion 20*b* of the leg portion 20. The locking end portion 22*a* is formed to be engaged with a locked end portion 52*a* of an engaged portion 52 of the socket 14 as described below.

On the base end portion 20*b* side of each of the pair of leg portions 20, base ends of the outer leg piece 25 and the inner leg piece 27 are connected to each other by arm portions 28 integrally extending from both ends of the attachment portion 24. Thus, each of the leg portions 20 is formed to have a space 29 surrounded by the outer leg piece 25, the inner leg piece 27, the distal end connection portion 23 and the arm portion 28. The arm portions 28 are respectively located on the base end portions 20*b* of the pair of the leg portions 20, which correspond to both ends of the attachment portion 24, and are formed in the shape of a straight line inclined with respect to the protruding direction of the leg portions 20 toward the middle portion in the right and left direction, thereby forming a generally V-shape. Arm distal end portions 28*a*, which oppose each other at the middle portion, have a predetermined gap therebetween and thus are configured to oppose each other as an end portion of a slit 32 of a guide portion 30 as described below. A position of the arm distal end portions 28*a* in the protruding direction is located toward the attachment portion 24 rather than a half of a length from the attachment portion 24 to the distal ends of the leg portions 20. If the position of the arm distal end portions 28*a* is closer to the attachment portion 24, a swing resistance when the leg portions 20 are operated is reduced, as compared with a case where the position of the arm distal end portions 28*a* is closer to the distal ends of the leg portions 20.

On the middle portion in the right and left direction, at which the arm distal end portions 28*a* of the arm portions 28 oppose each other, a guide portion 30 for guiding insertion movement of the plug 12 into the socket 14 is provided parallel to the protruding direction of the leg portions 20. The guide portion 30 is formed in an elongated U-shape to have parts integrally extending from the arm distal end portions 28*a* in the forward and back direction while being parallel to and opposing each other in the right and left direction. A distal end portion 30*a* of the guide portion 30 is formed by connecting the parts in the vicinity of the distal end connection portions 23 of the leg portions 20, and a space inside the U-shape of the guide portion 30 is formed as a slit 32. A length dimension of the slit 32 along the protruding direction is preferably greater than a half of a length dimension of the guide portion 30 along the protruding direction. A position of the distal end portion 30*a* is located slightly closer to the base end portions 20*b* in the forward and back direction than are distal ends of the distal end connection portions 23 of the leg portions 20.

The attachment portion 24 has a first bar 33 at an end portion of the plug 12 and a second bar 34 for connecting the base end portions 20*b* of the pair of leg portions 20. The first and second bars 33, 34 are provided parallel to each other in the right and left direction and also integrally provided to form a tape insertion hole 24*a* therebetween. Further, a portion surrounded by the second bar 34 and the arm portions 28 is also provided as a space to form a tape insertion hole 24*b*. The first bar 33 is formed to have the same width in the front and back direction as that of the attachment portion 24, and the second bar 34 is located on a front surface side, in the front and back direction, of the attachment portion 24 and is formed to be thinner than the first bar 33 in the front and back direction.

The socket 14 is also formed by integrally molding using a synthetic resin, such as polyacetal, polyamide or polypropylene. As shown in FIGS. 6 to 12, the socket 14 is constituted of a hollow fitting portion 40 configured to allow the leg portions 20 of the plug 12 to be inserted therein, and an attachment portion 42 opposite to an insertion opening 40*a* of the fitting portion 40. The attachment portion 42 has a tape insertion hole 42*a* formed to allow a predetermined member, such as a tape, a belt or other members, to be inserted therethrough and is also provided with a connection bar 44 configured to allow a tape member or the like to be connected thereto.

The fitting portion 40 of the socket 14 has an upper surface portion 45 and a lower surface portion 46, which face each other with a predetermined gap therebetween to form an insertion space for the plug 12. End portions of the upper surfaced portion 45 and the lower surface portion 46 close to the insertion opening 40*a* are formed in a generally V-shape to be inclined toward the middle portion thereof and thus toward the middle of the insertion opening 40*a* in the forward and back direction. Side surfaces of the socket 14 in the right and left direction are respectively provided with side wall portions 48 opposing each other. Also, on the middle portions of the side wall portions 48 in the forward and back direction, operation holes 50 are respectively formed to expose the respective operating portions 26 of the leg portions 20. The operation holes 50 are formed to be curved in a recessed shape and thus to approach each other in the right and left direction, thereby allowing the operation holes 50 to be exposed in the right and left direction.

On inner surfaces of the upper surfaced portion 45 and the lower surface portion 46 of the fitting portion 40, guide grooves 56 for guiding insertion movement of the plug 12 are respectively formed to extend from the insertion opening 40*a*. The guide grooves 56 are configured to extend from the insertion opening 40*a* in the forward and back direction and thus to guide sliding movement, in the forward and back direction, of the guide portion 30 fitted therein. At locations inside each of the upper surface portion 45 and the lower surface portion 46 of the fitting portion 40 close to the attachment portion 42, engaged portions 52 configured to allow a pair of engaging protrusions 22 to be engaged therewith are respectively provided to protrude therefrom while opposing each other in a space inside the fitting portion 40. Each of the engaged portions 52 has a locked end portion 52*a* configured to allow the locking end portion 22*a* of the corresponding engaging protrusion 22 to be engaged therewith while facing thereto. The locking end portion 22*a* and the locked end portion 52*a* are provided to have a surface perpendicular to the protruding direction of the leg portions 20. The engaged portions 52 are respectively provided with side surface portions 52*b*, which are surfaces formed to be inclined with respect to the forward and back direction in such a manner that they approach each other toward the attachment portion 42. Upon insertion of the plug 12, the side surface portions 52*b* abut against the engaging protrusions 22 to elastically deform the leg portions 20 in a direction approaching each other. Each of the engaged portions 52 of the lower surface portion 46 is provided to continuously extend along a peripheral edge of respective through-holes 54 opened adjacent to the tape insertion hole 42*a*. At a location on the lower surface portion 46, which is located between the through-holes 54 and adjacent to the attachment portion 42, an opening portion 58 is formed to be communicated with the tape insertion hole 42*a*, thereby preventing clogging of dust or the like when the plug 12 and the socket 14 are engaged with each other.

Next, the engaging operation and usage of the buckle 10 according to the present embodiment will be described below. In order to attach a tape member or the like to the plug 12 of the buckle 10, an end portion of a connecting tape member (not shown) is first inserted through the tape insertion hole 24*b* of the attachment 24 of the plug 12 from a back side thereof. Subsequently, after being passed about the second bar 34, the end portion of the tape member is inserted through the tape insertion hole 24*a* from a front side of the plug 12 and then is overlapped with the tape member itself on the back side of the tape insertion hole 24*a*. Thus, as the end portion is drawn out, the tape member can be freely adjusted in length. On the other hand, a tape member or the like (not shown) attached to the socket 14 is unadjustably connected to one connection bar 44.

As shown in FIGS. 13 to 15, engagement of the plug 12 with the socket 14 is performed by arranging the leg portions 20 of the plug 12 to oppose the insertion opening 40*a* of the socket 14 and then pushing the plug 12 into the socket 14. If the leg portions 20 is inserted into the fitting portion 40, outer surfaces of the engaging protrusions 22 of the leg portions 20 abut against the side surface portions 52*b* of the engaged portions 52. Thus, the leg portions 20 are first inserted therein while elastically deforming in a direction approaching each other. If the plug 12 is further pushed in, the engaging protrusions 22 are separated from the side surface portions 52*b* so that the pair of elastically deformed leg portions 20 returns to the original position. Then, the locking end portions 22*a* of the engaging protrusions 22 of the pair of leg portions 20 face the locked end portions 52*a* of the engaged portions 52, respectively, so that the engaging protrusions 22 and the engaged portion 52 are engaged with each other.

In order to disconnect the plug 12 from the socket 14, the pair of operating portions 26 are pressed from the outside thereof, so that the engaging protrusions 22 of the plug 12 are elastically deformed to a position where the engaging protrusions 22 don't face the engaged portions 52 of the socket 14. In this state, if the plug 12 and the socket 14 are slightly relatively moved in a direction away from each other, the engaging protrusions 22 are pushed away from the engaging position along the side surface portions 52*b* of the engaged portions 52 due to an elastic force of the leg portions 20. Thus, engagement is easily released.

During engaging and disengaging operations, the pair of the leg portions 20 of the plug 12 bends and also swings about the base end portions 20*b*, and hence the arm distal end portions 28*a*, which are an opening portion of the slit 32 of the guide portion 30, are deformed to narrow a space therebetween. Therefore, the engaging protrusions 22 are moved away from the position where the engaging protrusions 22 face the engaged portions 52. As a result, inserting or removing of the plug 12 into or from the socket 14 is allowed.

According to the buckle 10 of the present embodiment, the opening portion of the slit 32 of the guide portion 30 is deformed to narrow a space thereof when the pair of leg portions 20 bends about the base end portions 20*b*. Therefore, it is possible to obtain a bent dimension of the leg portions 20, which is required upon engaging and disengaging of the engaging protrusions 22, by elastically deforming the leg portions 20 with a small force, as compared with a case where the leg portions 20 are elastically deformed only by bending of the outer leg piece 25 and the inner leg piece 27 thereof. In particular, since the length dimension of the slit 32 along the protruding direction is set to be greater than a half of the length dimension of the guide portion 30 along the protruding direction, the leg portions 20 can be bent with a smaller force, thereby enhancing operability. In addition, even when an external force causing deformation in directions other than the operating direction of the leg portions 20 is exerted on the leg portions 20, the outer leg pieces 25, the inner leg pieces 27 and the arm portions 28 withstand against the external force to prevent plastic deformation or breakage. In particular, when a force is exerted on the leg portions 20 in a direction pulling away from each other, the arm portions 28 withstands to prevent deformation or breakage of the leg portions 20.

Figure 16:
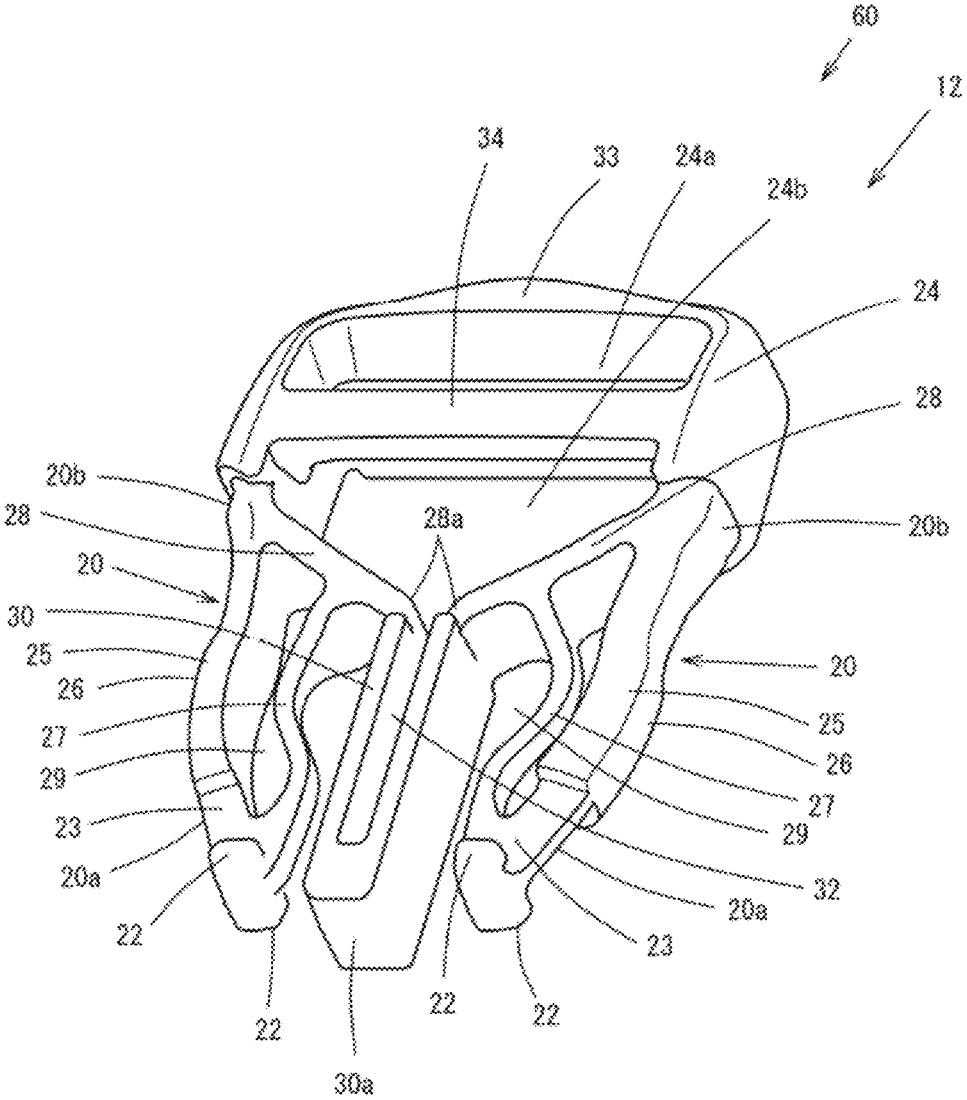
FIG. 16 is a perspective view showing a plug of a buckle according to a second embodiment of the present invention.
Figure 17:
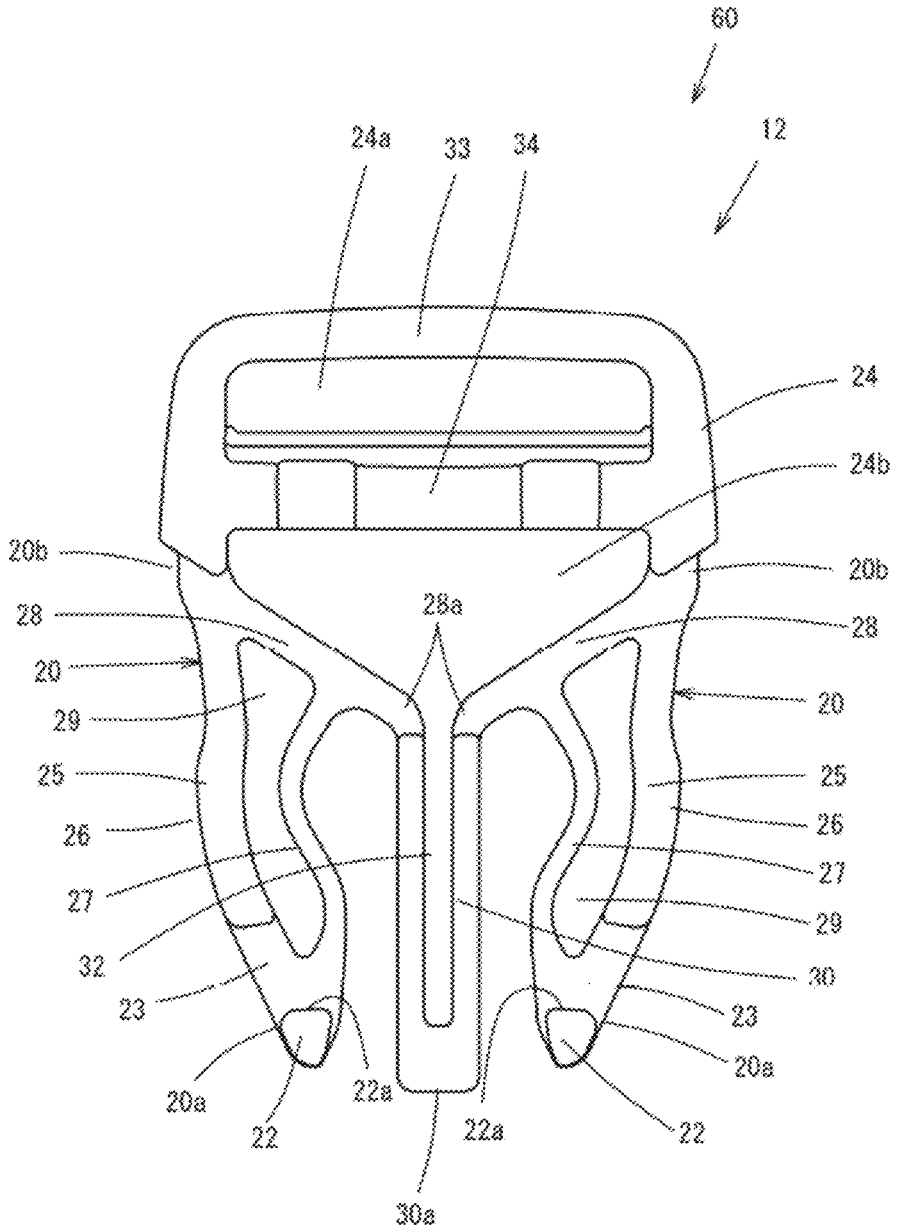
FIG. 17 is a front view of the plug of the buckle according to the second embodiment.

Next, a second embodiment of the present invention will be described with reference to FIGS. 16 and 17. Herein, the same members as those of the foregoing embodiments are denoted by the same reference numerals and the descriptions thereof will be omitted. In a buckle 60 of the present embodiment, a distal end portion 30*a* of a guide portion 30 provided on a plug 12 is positioned to slightly protrude relative to distal end connection portions 23 of leg portions 20 in the forward and back direction.

According to the buckle 60 of the present invention, effects similar to those of the foregoing embodiment can be achieved. In addition, since a length of the guide portion 30 in the protruding direction is longer, an operation of inserting the plug 12 into a socket 14 can easily performed.

Figure 18:
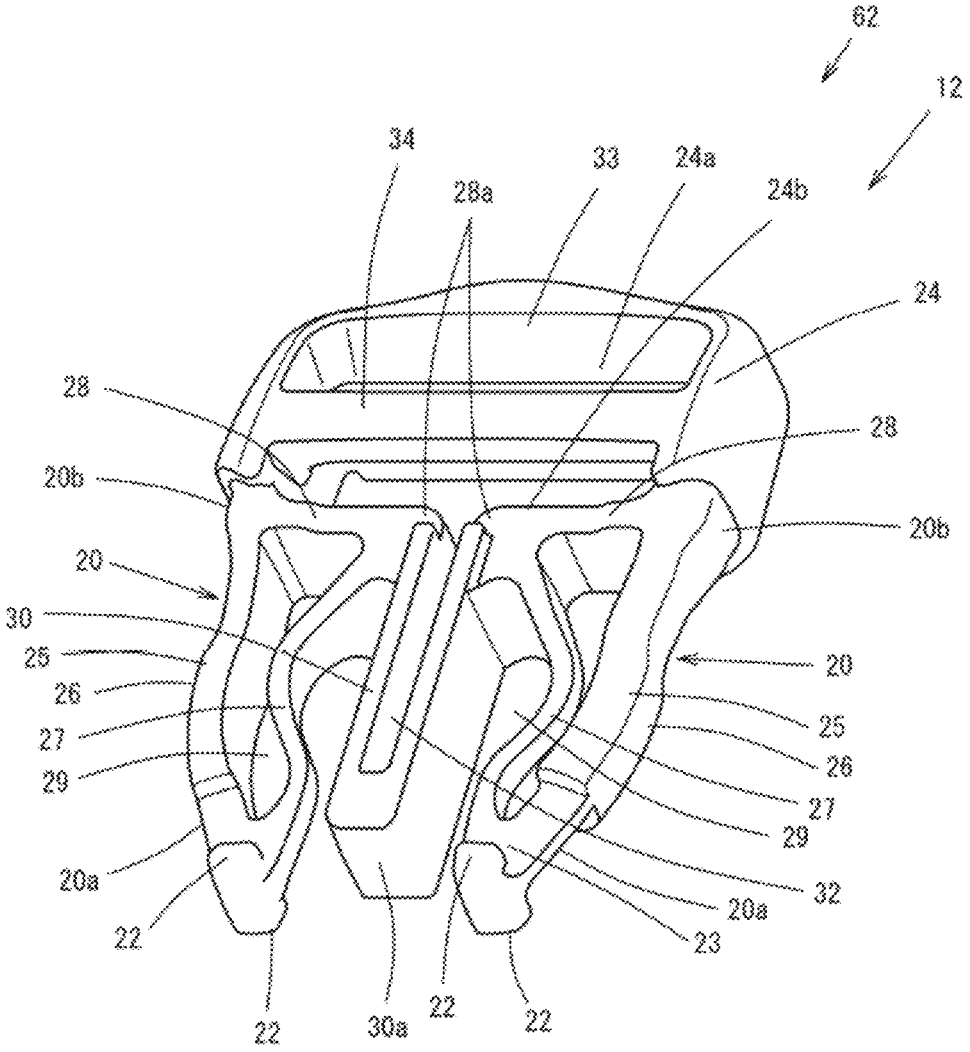
FIG. 18 is a perspective view showing a plug of a buckle according to a third embodiment of the present invention.
Figure 19:
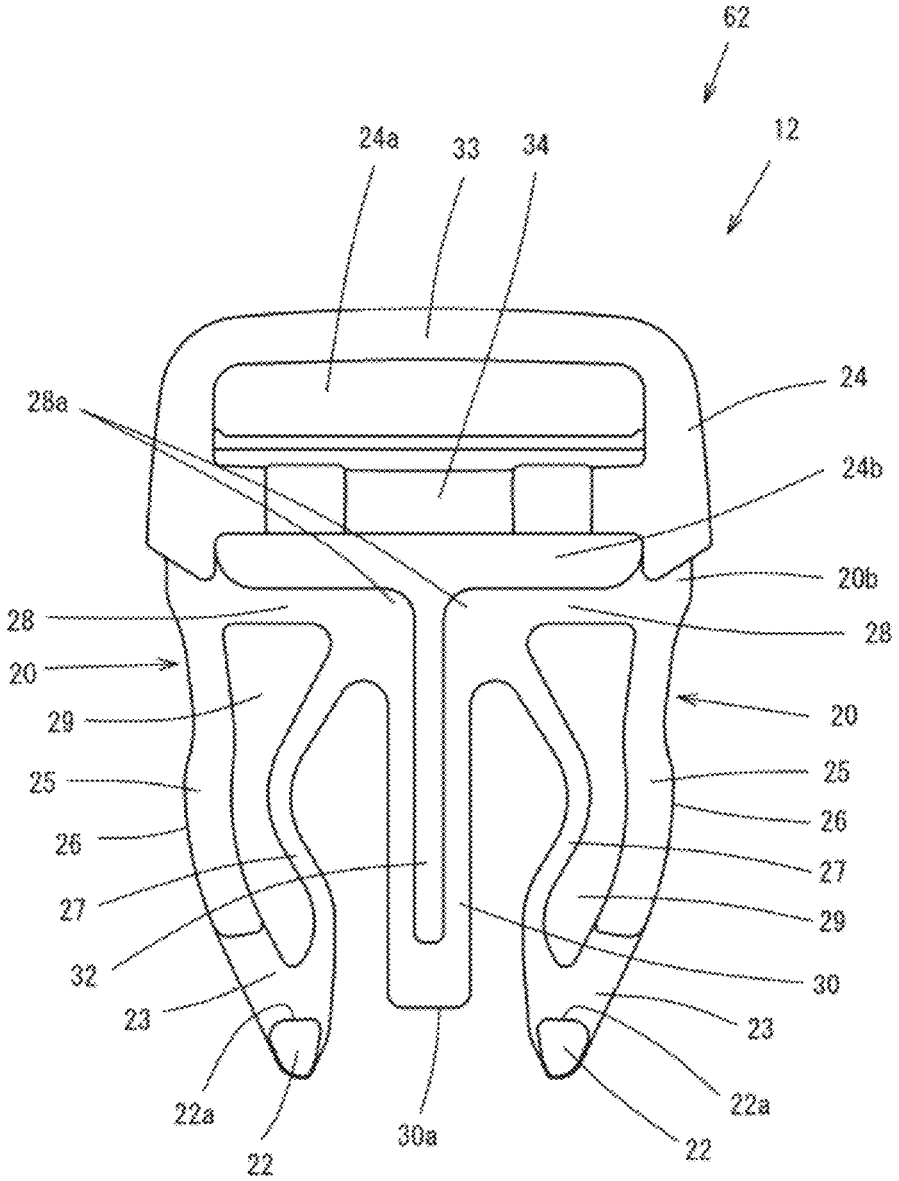
FIG. 19 is a front view of the plug of the buckle according to the third embodiment.

Next, a third embodiment of the present invention will be described with reference to FIGS. 18 and 19. Herein, the same members as those of the foregoing embodiments are denoted by the same reference numerals and the descriptions thereof will be omitted. In a buckle 62 of the present embodiment, an arm portion 28 for connecting an outer leg piece 25 and an inner leg piece 27 of each of leg portions 20 to each other on base end portions thereof is provided to be parallel to the right and left direction, and thus a slit 32 is configured to be opened in the vicinity of base end portions 20*b* of the leg portions 20. Thus, the slit 32 of the guide portion 30 is positioned in the vicinity of the base end portions 20*b* of the leg portions 20.

According to the buckle 62 of the present invention, effects similar to those of the foregoing embodiments can be achieved. In addition, since the arm portions 28 are arranged perpendicular to the protruding direction of the leg portions 20, the arm portions 28 are moved to narrow a space between arm distal end portions 28*a* thereof and also are swung in the forward and back direction upon operating of the leg portions 20. Also, since a length of inner leg pieces 27 is increased, the leg portions 20 can be operated with a lighter force.

Figure 20:
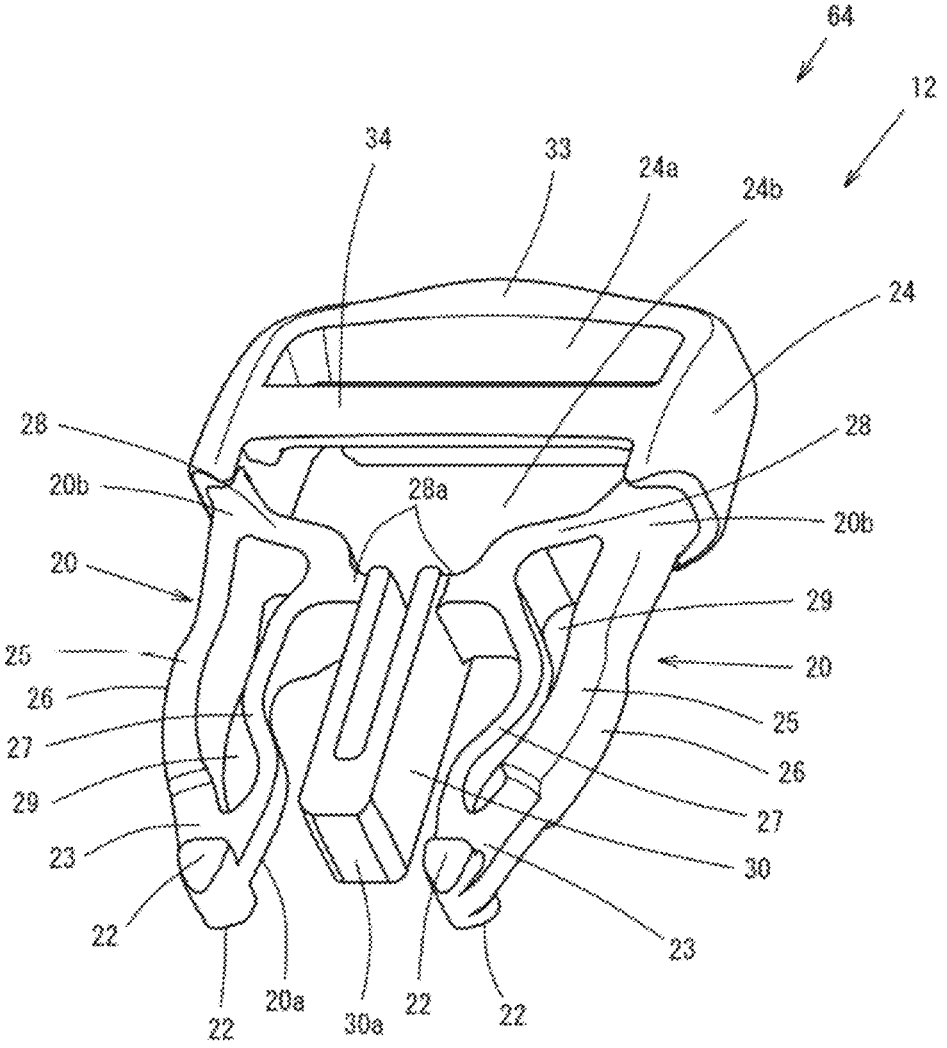
FIG. 20 is a perspective view showing a plug of a buckle according to a fourth embodiment of the present invention.
Figure 21:
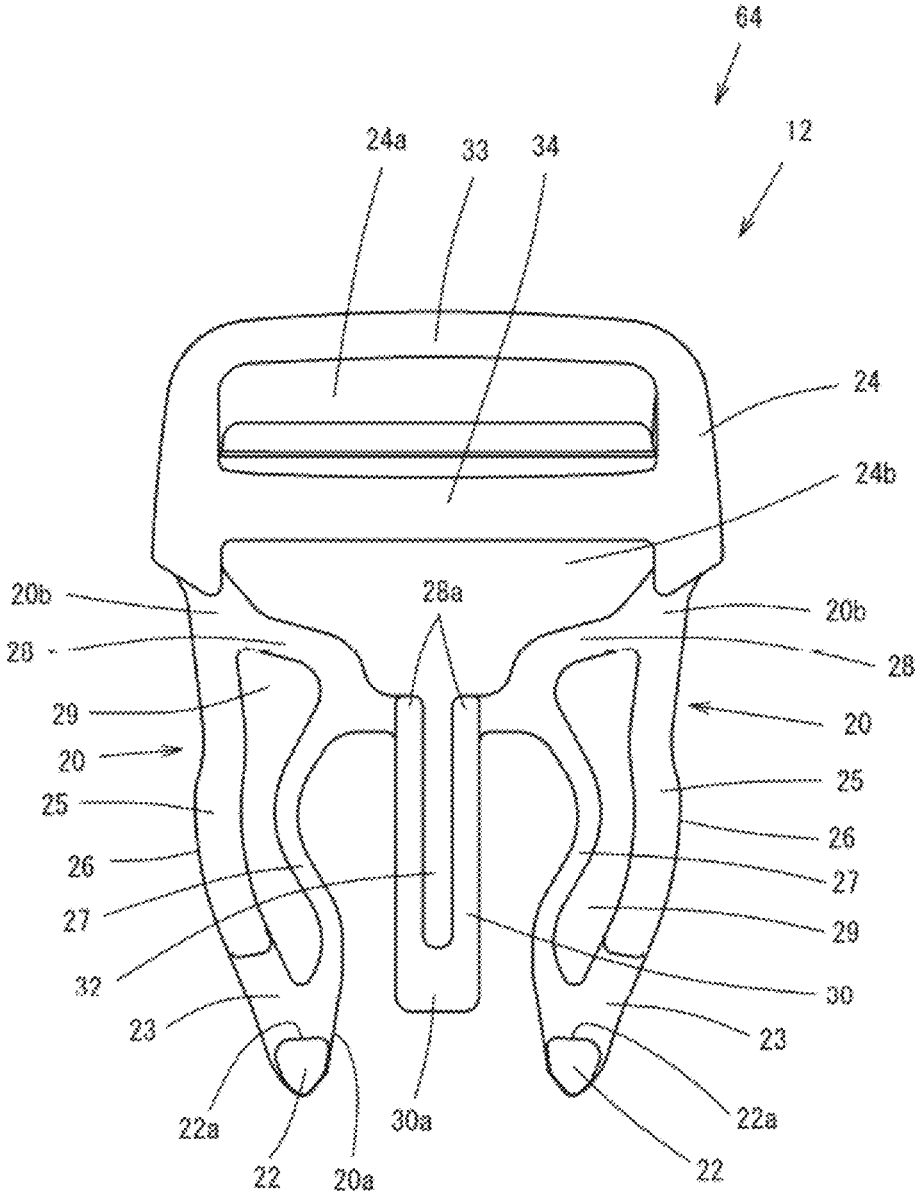
FIG. 21 is a front view of the plug of the buckle according to the fourth embodiment.

Next, a fourth embodiment of the present invention will be described with reference to FIGS. 20 and 21. Herein, the same members as those of the foregoing embodiments are denoted by the same reference numerals and the descriptions thereof will be omitted. In a buckle 64 of the present embodiment, an arm portion 28 for connecting an outer leg piece 25 and an inner leg piece 27 of each of leg portions 20 to each other on base end portions thereof is configured to be curved in the forward and back direction in the middle thereof, and thus arm distal end portions 28*a* thereof are arranged to oppose each other across a slit 32 of a guide portion 30.

According to the buckle 64 of the present invention, effects similar to those of the foregoing embodiments can be achieved. Since the arm portions 28 are arranged perpendicular to the protruding direction of the leg portions 20 and also the arm distal end portions 28*a* thereof are positioned to be spaced from a second bar 34 of an attachment portion 24, it is possible to increase a length of inner leg pieces 27 and also to widen a tape insertion hole 24*b*, thereby achieving a good operability and handling.

Meanwhile, the buckle of the present invention is not limited to the foregoing embodiments. Accordingly, the engaging protrusions 22 provided on the leg portions 20 may be provided on a base end side of the leg portions 20, instead of the distal end portion thereof, and also the engaged portion 52 of the socket 14 may be provided inside the side wall portions 48. In addition, shapes of the leg portions 20 or the arm portions 28 may be properly set and also a length of the guide portion 30 or a width of the slit 32 may be properly set.

DESCRIPTION OF REFERENCE NUMERALS

10, 60, 62, 64 Buckle
12 Plug

14 Socket
20 Leg Portion
20*a* Distal End Portion
20*b* Base End Portion
22 Engaging Protrusion
23 Distal End Connection Portion
24, 42 Attachment Portion
24*a*, 24*b*, 42*a* Tape Insertion Hole
25 Outer Leg Piece
26 Operating Portion
27 Inner Leg Piece
28 Arm Portion
28*a* Arm Distal End Portion
29 Space
30 Guide Portion
32 Slit
33 First Bar
34 Second Bar
40 Fitting Portion
40*a* Insertion Opening
44 Connection Bar
45 Upper Surface Portion
46 Lower Surface Portion
50 Operation Hole
52 Engaged Portion

The invention claimed is:

1. A buckle comprising:

a plug and a socket capable of being connected to each other and having attachment portions, respectively, configured to be attached to respective predetermined members, wherein the plug comprises a pair of leg portions protruding from the attachment portion, wherein each of the pair of leg portions is provided with an engaging portion, wherein each leg portion comprises an outer leg piece and an inner leg piece extending while opposing each other, wherein in a vicinity of a distal end portion of the leg portion, the outer leg piece and the inner leg piece are connected to each other by a distal end connection portion and also on a base end portion of the leg portion, the outer leg piece and the inner leg piece are connected to each other by an arm portion, and wherein opposing arm distal end portions of the arm portions are separated from each other to define a slit having a predetermined space between the arm portions, wherein the opposing arm distal end portions are connected to guide portions extending in a protruding direction of the leg portions, wherein the pair of leg portions is provided to be swingable across the slit.

2. The buckle according to claim 1, wherein the guide portions extend from the arm distal end portions to be parallel to each other to define the slit therebetween.

3. The buckle according to claim 1, wherein a pair of arm portions is formed to extend toward the protruding direction of the leg portions as the arm portions go from portions thereof connected to the outer leg pieces toward the arm distal end portions.

4. The buckle according to claim 1, wherein a length dimension of the slit along the protruding direction is set to be greater than a half of a length dimension of the guide portions along the protruding direction.

5. The buckle according to claim 2, wherein a distal end portion of the guide portions is positioned toward the base end portions of the leg portions rather than the distal end portions thereof.

6. The buckle according to claim 2, wherein a distal end portion of the guide portions protrudes in the protruding direction of the leg portions relative to the distal end portions of the leg portions.

* * * * *